US009156302B2

(12) United States Patent
Winchcombe

(10) Patent No.: US 9,156,302 B2
(45) Date of Patent: Oct. 13, 2015

(54) SUBSTRATES INCORPORATING SECURITY DEVICES

(75) Inventor: John Philip Winchcombe, Hampshire (GB)

(73) Assignee: De La Rue International Limited, Hampshire (GB)

( * ) Notice: Subject to any disclaimer, the term of this patent is extended or adjusted under 35 U.S.C. 154(b) by 2844 days.

(21) Appl. No.: 11/587,763

(22) PCT Filed: Apr. 28, 2005

(86) PCT No.: PCT/GB2005/001628

§ 371 (c)(1),
(2), (4) Date: Jul. 3, 2007

(87) PCT Pub. No.: WO2005/105472

PCT Pub. Date: Nov. 10, 2005

(65) Prior Publication Data

US 2008/0036195 A1 Feb. 14, 2008

(30) Foreign Application Priority Data

Apr. 30, 2004 (GB) ..... 0409736.6

(51) Int. Cl.
*B42D 15/00* (2006.01)
*B42D 15/10* (2006.01)
(Continued)

(52) U.S. Cl.
CPC ..... *B42D 25/00* (2014.10); *B42D 25/29* (2014.10); *B41P 2233/51* (2013.01); *B42D 2035/34* (2013.01); *B42D 2035/50* (2013.01)

(58) Field of Classification Search
CPC ..... B42D 3/18; B42D 15/00; B42D 15/10
USPC ..... 281/51; 283/57, 58, 59, 72, 85, 87, 94, 283/105, 108, 109, 117, 901, 903, 904
See application file for complete search history.

(56) References Cited

U.S. PATENT DOCUMENTS 5,393,099 A 2/1995 D'Amato ..... 283/91
5,783,275 A 7/1998 Muck et al.
(Continued)

FOREIGN PATENT DOCUMENTS

DE 10218897 11/2003
EP 0400902 5/1990
(Continued)

OTHER PUBLICATIONS

PCT Internation Search Report dated Oct. 26, 2005 in respect to corresponding PCT Application No. PCT/GB2005/001628 filed Apr. 28, 2005.

*Primary Examiner* — Shelley Self
*Assistant Examiner* — Justin V Lewis
(74) *Attorney, Agent, or Firm* — Ohlandt, Greeley, Ruggiero & Perle, L.L.P.

(57) ABSTRACT

This invention is directed to improvements in substrates, such as paper, incorporating a security device, and to documents made therefrom. The security substrate comprises at least one elongate security device, which security device has a series of first regions exposed at a series of windows formed in at least a first surface of the substrate and a series of second regions covered by the substrate at bridges formed between the windows in the first surface of the substrate. Each of the first regions is provided with a first security feature which is substantially of the same appearance in each region and is visible in each window when the first surface of the substrate is viewed ire reflected light. The second regions are provided with a second security feature which is substantially of the same appearance in each second region but is different from the first security feature and is not visible when the first surface of the substrate is viewed in reflected light, but is visible when the first surface of the substrate is viewed in transmitted light.

22 Claims, 9 Drawing Sheets

(51) Int. Cl.
*B42D 25/00* (2014.01)
*B42D 25/29* (2014.01)

(56) References Cited

U.S. PATENT DOCUMENTS

| | | | | |
|---|---|---|---|---|
| 6,030,691 | A | 2/2000 | Burchard et al. | 428/195 |
| 6,471,247 | B1 | 10/2002 | Hardwick et al. | 283/72 |
| 7,611,168 | B2 * | 11/2009 | Heim | 283/85 |

FOREIGN PATENT DOCUMENTS

| | | | |
|---|---|---|---|
| EP | 0723501 | | 7/1996 |
| WO | WO 92/10608 | | 6/1992 |
| WO | WO 95/09274 | | 4/1995 |
| WO | 9526884 | A1 | 10/1995 |
| WO | WO 03070482 | A1 * | 8/2003 |
| WO | WO 2004/020218 | | 3/2004 |

* cited by examiner

SUBSTRATES INCORPORATING SECURITY DEVICES

This invention is directed to improvements in substrates, such as paper, incorporating a security device, and to documents made therefrom.

It is generally known to provide security devices in or on security paper, as a security feature. Such devices can be patches, foils, threads, strips or ribbons of, for example, plastics film, metal foil, metallised plastic, metal wire. These security devices are included in the thickness or on the surface of security paper to render imitation of documents produced from the paper more difficult. These devices help in the verification of security documents as they render the view of the documents in reflected light different from that in transmitted light. To increase the security provided by the inclusion of such a device, it is also known to endow the device itself with one or more verifiable properties over and above its presence or absence. Such additional properties include magnetic properties, electrical conductivities, the ability to absorb x-rays and fluorescence.

As a further security feature, it has been found to be particularly advantageous to provide windows in one side of the surface of the paper, which expose elongate security elements (or threads) at spaced locations. Examples of methods of manufacturing paper incorporating security elements with or without windows are described below. It should be noted that references to "windowed thread paper" include windowed paper incorporating any elongate security element.

EP-A-0059056 describes a method of manufacture of windowed thread paper on a cylinder mould paper-making machine. The technique involves embossing the cylinder mould cover and bringing an impermeable elongate security element into contact with the raised regions of an embossed mould cover, prior to the contact entry point into a vat of aqueous stock. Where the impermeable security element makes intimate contact with the raised regions of the embossing, no fibre deposition can occur. After the paper is fully formed and couched from the cylinder mould cover, the water is extracted from the wet fibre mat and the paper is passed through a drying process. In the finished paper the contact points are present as exposed regions which ultimately form windows, visible in reflected light, on one side of a security or banknote paper.

WO-A-93/08327 describes a method of manufacturing windowed thread paper on a Fourdrinier paper-making machine. A rotating embedment means, with a modified profile for embossing, is used to drive an impermeable elongate security element into draining paper stock, on a Fourdrinier wire. The profile of the embedment means is such that raised portions are provided which remain in contact with the security element during the embedment process. Thus, paper fibres are prevented from collecting between the security element and embedment means, such that the security element is subsequently exposed in windowed regions of paper.

WO 03/054297 and WO 03/097937 describe security paper which has an aperture which extends through the full thickness of the base paper substrate, over which is applied a security element in the form of a patch. The patch may be transparent, translucent or, in the former specification, be provided with other security features.

Other prior art describing security devices in the form of patches applied to the surface of a base substrate include EP-A-724519 and EP-A-723501.

The security devices provide a suitable means for carrying information, indicia or other security features, which can be used to verify the authenticity of a document made from paper incorporating such devices. However, the devices are made separately from the paper and applied to/embedded within the paper/substrate without any correlation between the device and the paper substrate in the longitudinal or machine direction.

It is desirable to use the security devices to carry a plurality of different security features, which can be verified under a plurality of different viewing conditions, as this enhances the security of the resulting substrate in which they are embedded. However, where a security device has more than one visual security feature, they may visually interfere with each other in particular it is noted that optically variable effects may be compromised by demetallised features, such as Cleartext®.

It is therefore an object of the present invention to provide a security substrate with a security device, which has at least two different security features, the device being arranged so that the different security features can be separately verified under different viewing conditions, without compromising the appearance of each other.

A security substrate comprising at least one elongate security device, which security device has a series of first regions exposed at a series of windows formed in at least a first surface of the substrate and a series of second regions covered by the substrate at bridges formed between the windows in the first surface of the substrate, wherein each of the first regions comprises a first security feature which has substantially the same appearance in each region and is visible in each window when the first surface of the substrate is viewed in reflected light and the second regions comprise a second security feature which has substantially the same appearance in each second region but is different from the first security feature and is not visible when the first surface of the substrate is viewed in reflected light, but is visible when the first surface of the substrate is viewed in transmitted light.

The invention also provides a security substrate comprising at least one security device, which security device has a first region exposed at a window or aperture formed in at least a first surface of the substrate, and a second region covered by the substrate which is therefore not visible at the first surface of the substrate, wherein the first region comprises a first security feature which is visible when the first surface of the substrate is viewed in reflective light and the second region comprises a second security feature which is different from the first security feature and is not visible when the first surface of the substrate is viewed in reflective light, but is visible when the first surface of the substrate is viewed in transmitted light.

The invention further provides for a set or series of documents each member of which has the same combination of security features across the set or series registered in the same manner in each document. The series could be, say all banknotes for a particular country, or one denomination of banknotes.

The invention uses the fact that certain security features are particularly suitable for viewing in transmissive light, and can be hidden from view in reflection, leaving an optical feature to be viewed "cleanly" without interference in reflection. Negative demetallised indicia such as Cleartext™ which comprise clear regions forming text surrounded by opaque regions, preferably of vacuum deposited metal is especially suitable, although other materials such as metallic inks may be used. Each feature is then localised in an area most appropriate, i.e. obscured by the substrate, or exposed in windows.

The invention will now be described, by way of example only, with reference to the accompanying drawings in which:

FIG. 1 is a cross sectional end elevation of a substrate according to the present invention on the line A-B of FIG. 1A;

FIG. 1*a* is a plan view of a substrate according to the present invention

Figure 19A:
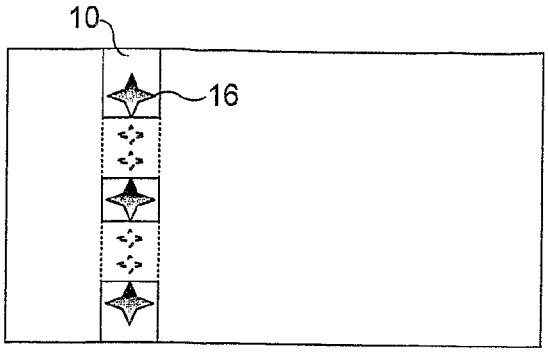
Figure 19B:
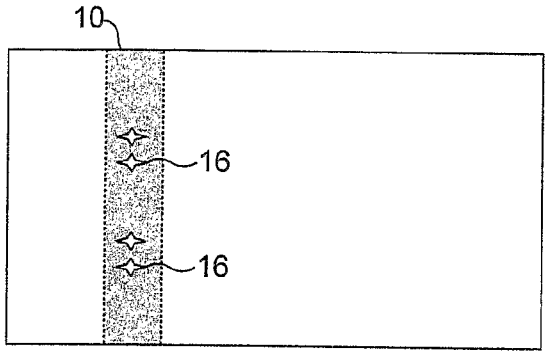
Figure 20:
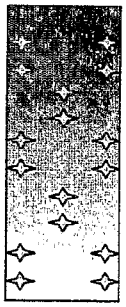
Figure 21A:
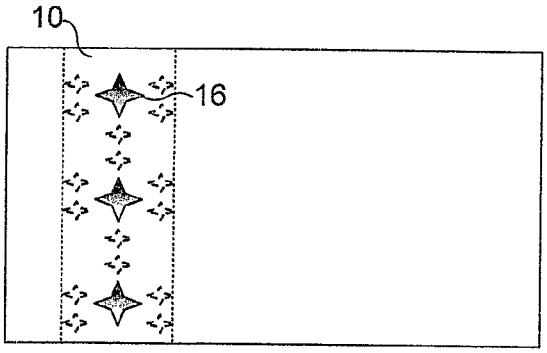
Figure 21B:
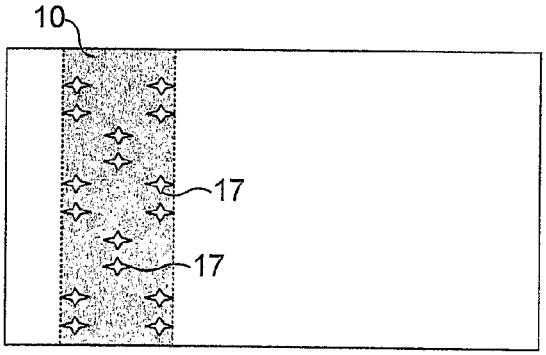
Figure 22:
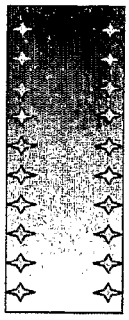
Figure 23A:
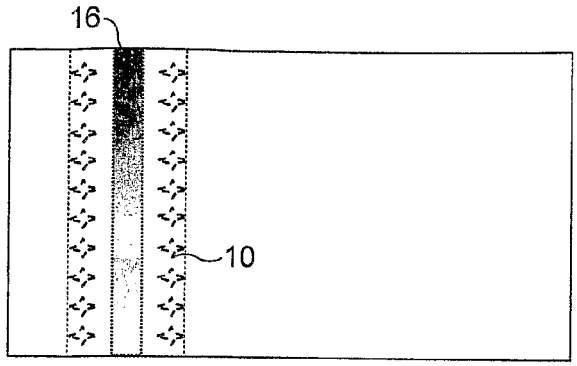
Figure 23B:
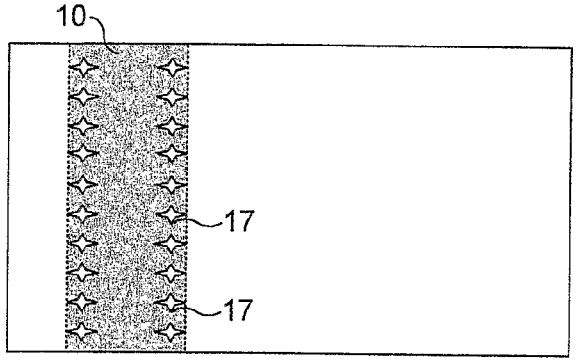
Figure 24:
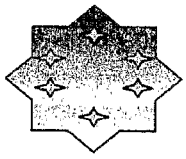
Figure 25A:
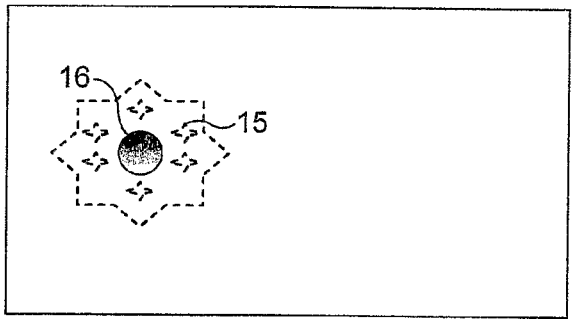
Figure 25B:
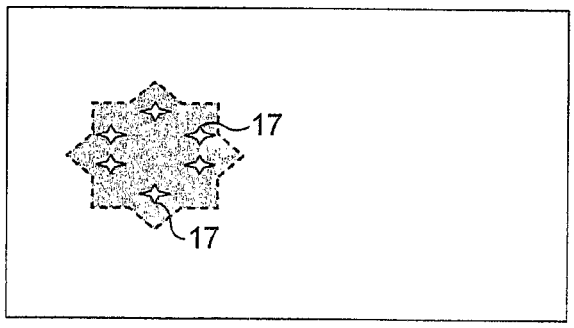

FIGS. 19*a*/19*b*, 21*a*/21*b* 23*a*/23*b* and 25*a*/25*b* are plan views of substrates using the security elements of FIGS. 18, 20, 22 and 24 respectively viewed in reflected and transmitted light respectively; and FIGS. 26 to 32 are plan views of alternative security devices for use in the substrate of the invention.

One method suitable for use in manufacturing a substrate 12, such as paper, having windows 11 or apertures in at least one surface, for use in the present invention is the well known cylinder mould method, as described in EP-A-0059056. Alternatively the Fourdrinier method can be used, for example as described in EP-A-609252. It should, however, be noted that the substrate 12 may be paper, or a paper substrate made from or containing synthetic fibres, or a plastic material.

The security devices 10, 15 described below are generally formed from a clear or translucent carrier material to which other layers as suggested below are applied.

Figure 1:
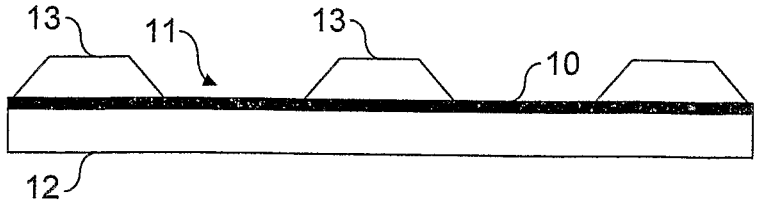
Figure 1A:
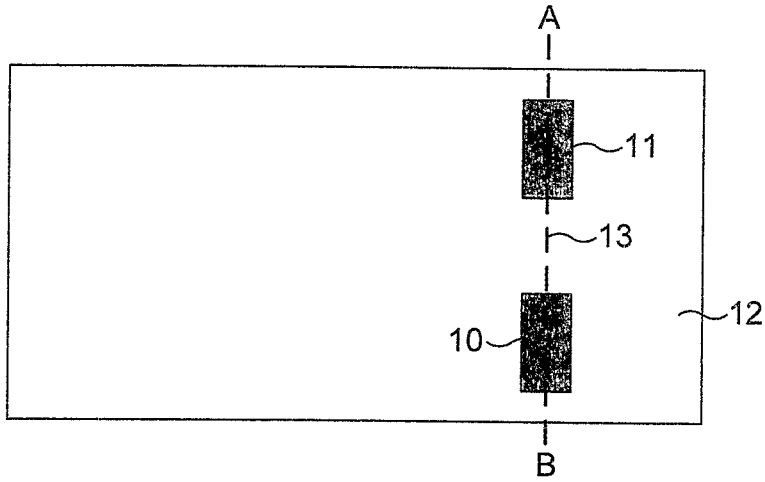
Figure 7:
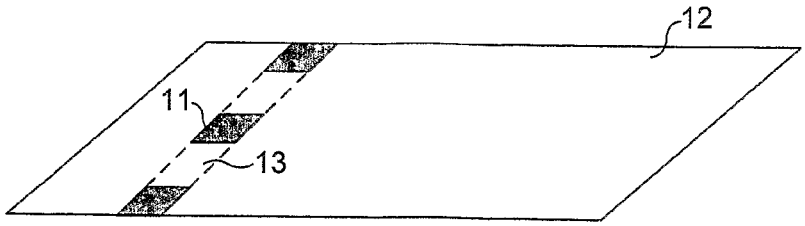
FIG. 7 is a pictorial representation of an upper surface of the substrate of FIG. 1.

In a first embodiment of the invention, as shown in FIGS. 1, 1*a* and 7, the security device is an elongate security element 10, regions of which are exposed at windows 11 in at least one surface (face) of a substrate 12. Between the windows 11, other regions of the element 10 are hidden under bridges 13 which are formed between the windows 11.

Figure 2:
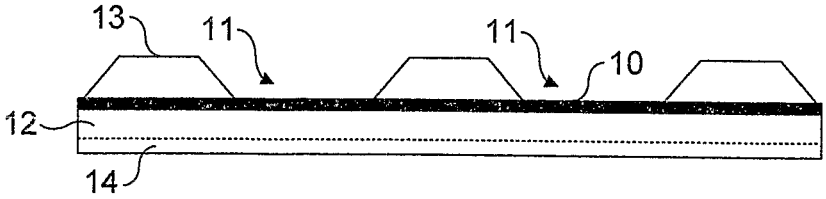
FIGS. 2 to 6 are cross sectional end elevations of alternative substrates to that of FIG. 1.
Figure 3:
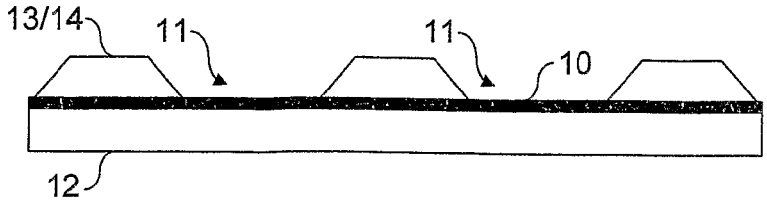

As an alternative to a single ply substrate 12, a multi ply substrate 12,14 can be used as shown in FIG. 2, in which a second ply 14 is separately formed and amalgamated with the first ply 12, in a method similar to that described in EP-A-860298. In this method the security element 10 is partially embedded in the first ply 12. Alternatively it can be inserted between two wet layers before lamination as taught in EP-A-229645, as shown in FIG. 3.

Figure 4:
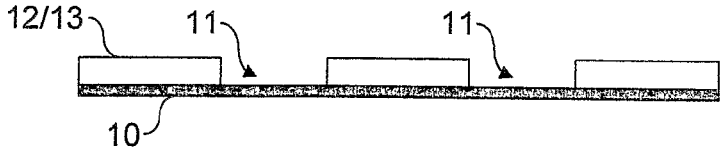

Additionally other paper making processes are equally applicable, such as in described in EP-A-1141480, in which the security element 10 is partially exposed in windows 11 on one surface of the substrate 12 and is wholly exposed on the opposing surface along its length, as shown in FIG. 4.

The security element 10 may also be applied postproduction of the finished substrate 12. For example, it could be inserted between two preformed webs as a part of a lamination process. It can also be applied to a single web.

Figure 5:
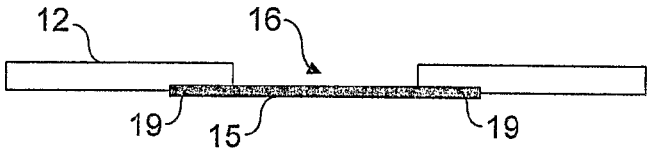
Figure 8:
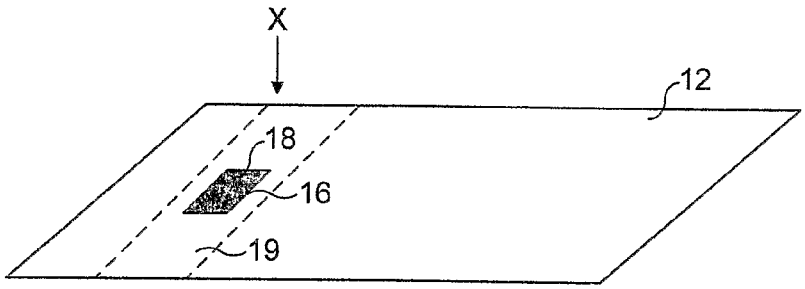
FIG. 8 is pictorial representation of an alternative substrate to that of FIG. 1.
Figure 9:
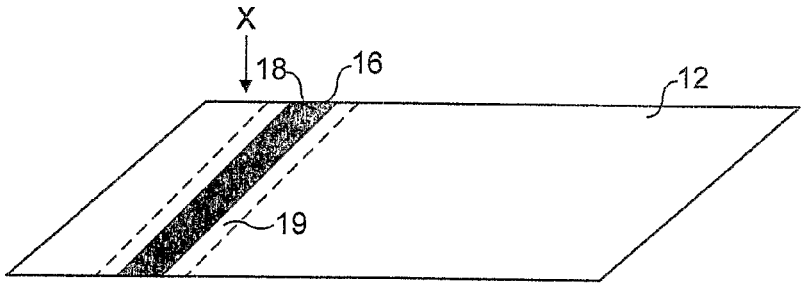
FIG. 9 is pictorial representation of the substrate of FIG. 4.
Figure 10:
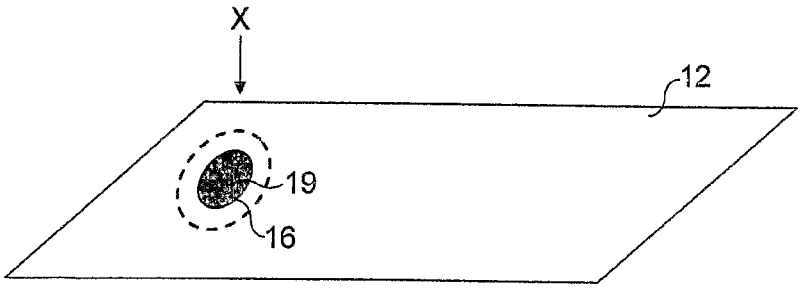
FIG. 10 is pictorial representation of the substrate of FIG. 5.

The security device may also comprise a patch 15, as shown in FIGS. 5 and 10, or a foil stripe 18 as shown in FIGS. 8 and 9 or other similar device, which is applied one surface of the substrate 12 so as to overlie an aperture 16, which may be in the form of a discrete hole through the thickness of the substrate 12 or a continuous track. When the opposing surface is viewed, one region of the device is exposed in the aperture 16 and the rest of the device 15 is hidden by the substrate 12.

The key aspect to the invention is that the security device is embedded in, or applied to a surface of, the substrate 12 in a manner such that when the substrate 12 is viewed from at least one side a first region or set of regions of the device, each region bearing the same (or substantially the same) first security feature which is exposed in windows or apertures in at least a first surface of the substrate 12 and a second region or set of regions of the device, each second region bearing the same (or substantially the same) second security feature which is completely hidden by the finished substrate on at least one surface so as not to be visible in reflected light, but which is visible in transmitted light.

Figure 12:
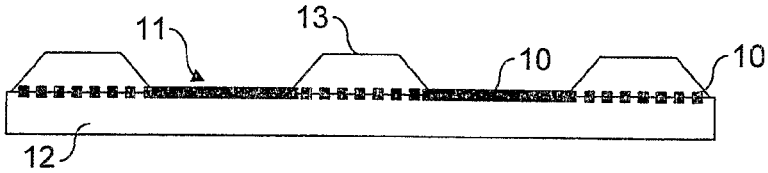
FIGS. 12 to 17 are cross sectional end elevations of alternative embodiments of a substrate according to the present invention.
Figure 13:
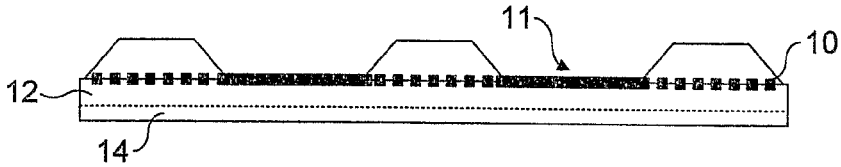
Figure 14:
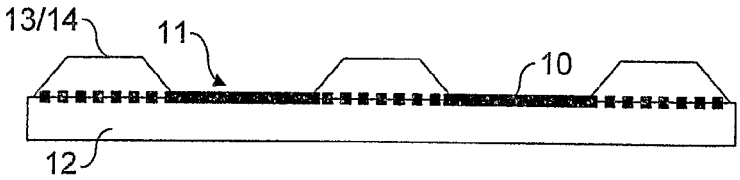

In the elongate element embodiment of the invention, shown in FIGS. 1, 1*a* and 7, the elongate security element 10 is provided with two security features. One comprises a series of, preferably identical, optical features which are visible in reflected light, such as a series of discrete holograms, at a first set of regions along the length of the element 10. Between the first security features are interspersed second security features, which comprises a series of, preferably identical, features which are visible in transmitted light through a covering of the substrate 12. These second features may be solid metal blocks or opaque regions, as shown in FIGS. 1 to 3. Alternatively they may comprise demetallised indicia or another partially opaque security feature, as shown in FIGS. 12 to 14.

The embedment of the element 10 in the substrate 12 is controlled such that the holograms are always displayed in the windows 11, and the metallised regions are always embedded and covered by the bridges 13. This ensures that the holograms are as fully exposed as possible in the windows 11. Thus when the substrate 12, as shown in FIG. 1, is viewed in reflected light as shown in FIG. 7, the predominant feature which will be seen will be the holograms (first security features) showing in the windows 11. The metallised regions (second security features) will be wholly obscured in reflected light by the bridges 13.

However, when the substrate 12 is viewed in transmitted light, the optical replay of the holograms fades and the metallised regions become suitable and combine with the holographic regions to be seen as a solid dark line. In the embodiments shown in FIGS. 12 to 14 the demetallised indicia will be clearly visible as bright gaps in the dark line. This provides a surprising, yet distinct, advantage over known arrangements of security features on security devices, whereby the clarity of a hologram exposed in a window is diminished by the presence of the highly reflective metallic areas in the same or other adjacent windows.

The bridges 13 may be longer in the machine direction than normal to cover longer metallised/demetallised regions. For example if demetallised indicia form the name of a country which is a long name which, with traditional bridge lengths, may often be partly obscured, extending the bridge lengths removes this problem. The length of the windows may also be increased, which would reduce the number of bridge and window portions overall.

Where the security device is a patch 15 or a stripe 16 which is applied to one surface of the substrate 12, it may only have a single first region and single second region, as illustrated in FIGS. 5 and 8 to 10. In these embodiments the first security feature which is in the first region of the device is visible when the substrate 12 is viewed in reflected light from the side of the other surface (see arrow X in FIGS. 8 to 10). The second region 19 overlaps with the substrate 12 so is obscured by the substrate 12 when viewed in this manner. However, when viewed in transmitted light, the second security feature on the second region 19 becomes visible.

Figure 15:
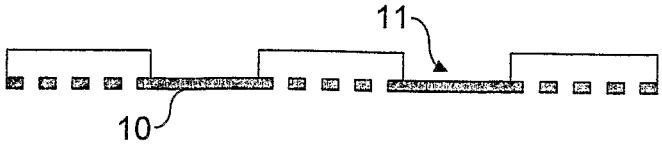
Figure 16:
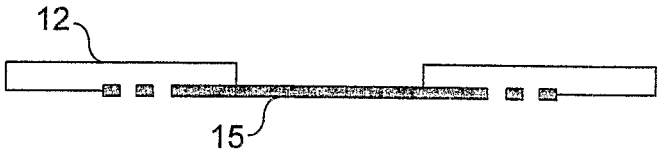
Figure 17:
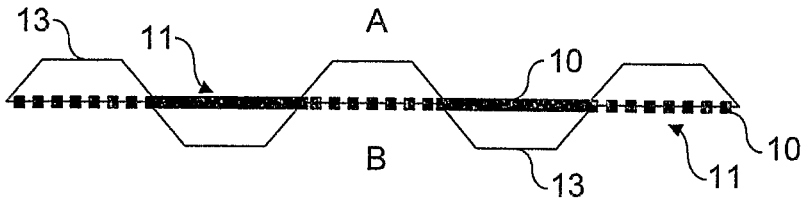
Figure 18:
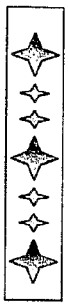
FIGS. 18, 20, 22 and 24 are plan views of alternative security elements for use in the present invention.

The embodiments shown in FIGS. 4 and 5 comprise a solid metal or opaque feature in the second region. Those in FIGS. 15 and 16 show demetallised indicia in this second region, or another partly opaque feature.

Depending on the method of production of the substrate, the means by which the security device 10, 15 is to be applied to or incorporated in the substrate 12 must be selected. To this end there are several options available for achieving this, during or postproduction. Examples of insertion during production are disclosed in WO 03/023140 and GB 0228424.8.

In WO 03/023140 a security thread is provided with security features by a laser immediately before insertion into a substrate. The laser is driven by a signal from the paper at a particular point in the production process, eg the speed of the watermarking roller. Using this information the system sets the unwinding speed of the thread spool and thus controls the positioning and thus registration of the thread with the substrate.

GB 0228424.8 describes a system which monitors the location of a control feature on a security element as it is being unwound and fed into the papermaking machine and a control feature on the substrate as it is formed. The system uses these position indicators to control the tension of the security element and rate of its embedment, so that the control features of the security element and substrate are in register.

Alternatively the device 10,15 can be applied or manipulated postproduction. Where a patch 15 or stripe is to be used (e.g. FIG. 5), this can be done using known registration systems to ensure that the device 15 is correctly placed on the substrate. Thus the device 15 can be placed such that the first region or set of regions, which are exposed and visible in reflected light, are placed over one or more apertures or holes in the substrate 12. The second region or set of regions, which are obscured in reflected light, and visible only in transmitted light, are placed so that they are obscured from at least one side of the substrate 12.

Figure 11:
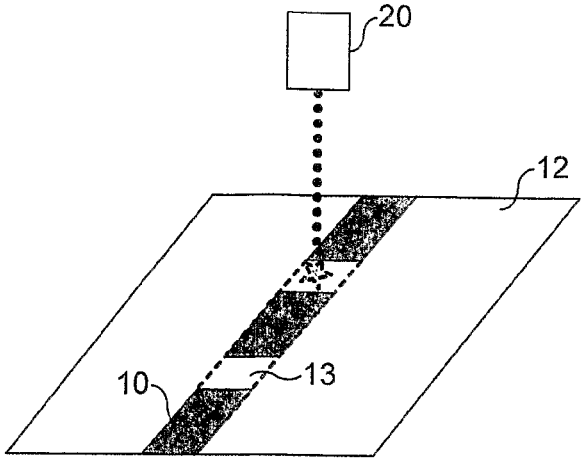
FIG. 11 is a pictorial representation illustrating a method of applying a security feature to a security thread after embedment.

In the case of partially embedded devices 10, 15, the creation of a reflective security feature in the first region(s) may be achieved by using a laser 20 or mechanical means, as shown in FIG. 11 after embedment/application.

Figure 6:
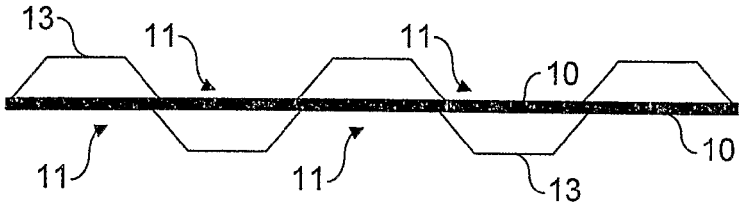

Although the preferred embodiment of the invention uses a partially embedded security device 10 which is exposed in windows 11 on one surface of the substrate 12, it can also be extended to exposure on both surfaces of the substrate 12, as shown in FIG. 6. For example, the substrate 12 could be provided with windows 11 that alternate on either surface of the substrate 12 so that the device 10 could be exposed in a window 11 at a first surface A, whilst obscured at the same point at the opposing surface B. Where the device 10 is obscured by a bridge 13 at surface A, it is exposed in a window 11 at surface B at that same point. This has the advantage that it provides an additional layer of complexity, which a counterfeiter would find it difficult to replicate.

Methods of providing substrates in which a security element is exposed at both sides of the substrate are described in EP-A-229645 and GB 0328288.6. In the former specification two layers of paper are formed separately. The security element is inserted between the layers, which are then pressed together and dried. Both of the individual layers can be provided with apertures, which will then expose the security element at both surfaces of the substrate.

In GB 0328288.6 a first set of windows in formed in one surface of the substrate where an impermeable elongate security element is in contact with window forming means (eg raised regions on a cylinder mould cover). The security element comprises a plurality of wide regions separated by narrow regions. A second set of windows is formed in the other surface of the substrate as the wide regions prevent the deposition of fibres, whilst the narrow regions are covered with a layer of fibres.

The device 10,15 may also be wholly exposed at one surface of the substrate 12, as shown in FIGS. 4,5,9 and 10, and only revealed in windows at a second surface. This would occur in the case where a patch 15 is applied over a hole or aperture, or an elongate element 10 is embedded in accordance with EP-A-1141480.

The invention also extends to the use of a security device 10,15 which has other features in place of the holograms. As stated above, the first security feature 16 or set of security features need to be visible in reflected light. They are most preferably optically variable, in that they vary upon change of viewing angle and without the need for additional external stimulus. Optically variable features include diffractive microstructures (holograms, Kinegrams™, Exelgrams™ and the like), volume holograms, optically variable inks (OVIs™), iridescent materials, liquid crystal materials and other colourshift features, dielectric thin film structures, metallic or bimetallic layers containing one or more vapour deposited or printed metals or metallic inks, microlen or microprism arrays (such as are described in GB 05049598 and GB 04097838 respectively). Other reflective features could include print features (using non-optically variable pigments), which can be black or coloured inks printed onto the device. The optically variable or printed features may be provided with additional functionality as is well known in the art, such as magnetic, conductive, polymer electronics, integrated circuit chips, luminescent, thermochromic, photochromic, or IR features. It should be noted that the reflective feature could be a high refractive index device or hologram, using a high refractive index coating (such as zinc sulphide) to provide the reflectivity. Combinations of any of the above could also be used.

The second security feature 17 or set of security features must be visible in transmitted light when embedded under the bridges 13, or otherwise obscured by the substrate, but must not be visible in reflected light. They therefore most preferably comprise metallised or demetallised indicia. A single metal may be used in the metallised layer, such as aluminium. Alternatively more than one metal can be used, such as a combination of aluminium and copper. Metallic inks and non-metallic opaque coatings comprising clear regions forming text may also be used.

The second security features may also be provided with additional functionality as desired above, such as magnetic, conductive, polymer electronics or IC chips.

Examples of the different views in reflected and transmitted light are given in FIGS. 19*a*/19*b*, 21*a*/21*b*, 23*a*/23*b* and 25*a*/25*b* for four different security devices 10, illustrated in FIGS. 18, 20, 22 and 24 respectively.

The security features of the first region(s) are designated 16 and those of the second region(s) 17.

It is preferable that the first security features 16 have some aesthetic quality, as they are always exposed.

Another example of a suitable combination of first and second security features 16, 17 comprises machine readable magnetic blocks, set at a pitch corresponding to be frequency of the windows 11 and metallic blocks incorporating demetallised indicia, the pitch of which corresponds to the frequency of the bridges 13. The dark magnetic blocks are provided with a layer of liquid crystal which, when viewed in reflected light, will give a colour shifting effect within the windows 11.

Figure 26:
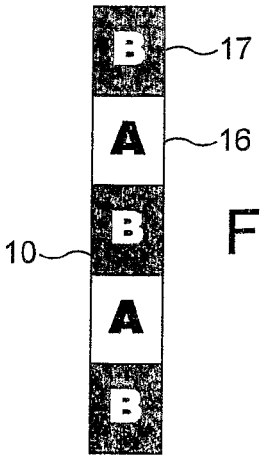
Figure 29:
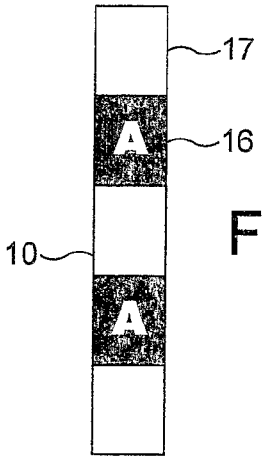
Figure 27:
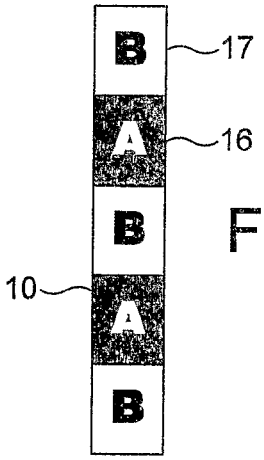
Figure 30:
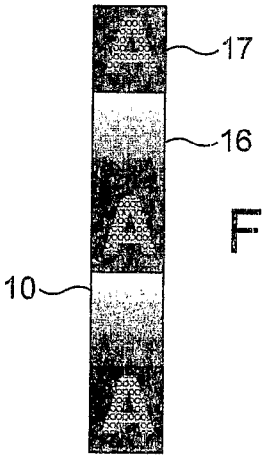
Figure 28:
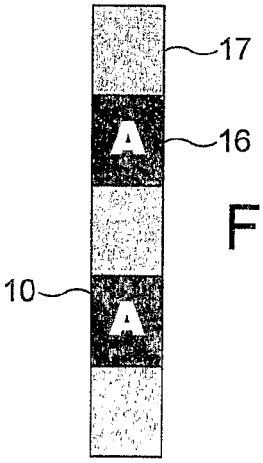
Figure 31:
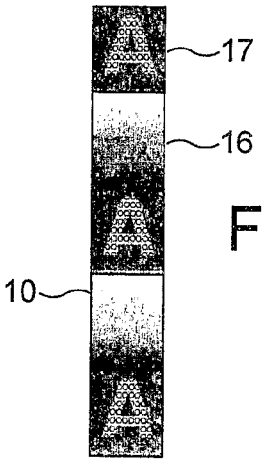
Figure 32:
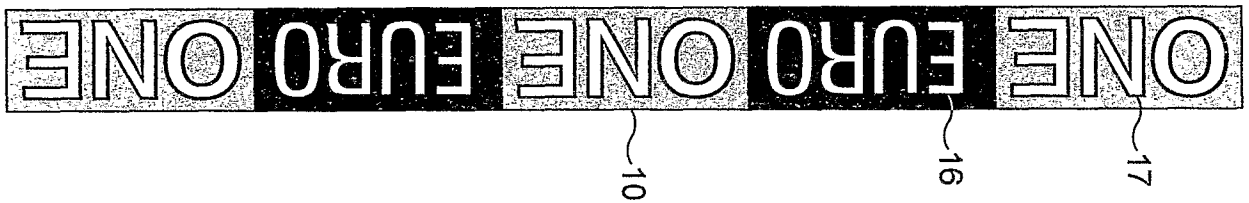

Other examples of particularly suitable combinations of first and second security features are given in the chart below:

| | First Security Feature 16 | Second Security Feature 17 |
|---|---|---|
| FIG. 26 | Metallised Indicia | Demetallised Indicia |
| FIG. 27 | Demetallised indicia | Metallised Indicia |
| FIG. 28 | Metallised or demetallised indicia | Solid metal blocks |
| FIG. 29 | Demetallised or metallised indicia | Regions of clear carrier material |
| FIG. 30 | Any optically variable feature | Indicia formed by microperforations in a metallic layer |
| FIG. 31 | Demetallised indicia with a dark layer covering the remaining metal regions with a liquid crystal material applied over the whole thread | Metallised or Demetallised indicia or microperforated indicia |
| FIG. 32 | Metallised or demetallised indicia in the form of a word or combination of words | Different word or combination of words formed from metallised or demetallised indicia |
| | Microlens array | Metallised or demetallised indicia |
| | Microprism array | Metallised or demetallised indicia |

N.B. The demetallised and metallised indicia can be replaced by other negatively and positively formed indicia.

Where indicia are proposed for both of the first and second security features 16, 17, these will necessarily have different appearances in the two security features 16, 17. For example the letter A may form the first security feature 16 and letter B the second security feature 17. Alternatively, words such as ONE could form the first security feature 11 and "EURO" could form the second security feature 17, so when viewed in transmitted light the whole phrase "ONE EURO" is visible.

As a further alternative indicia, whether in the form of words or a pattern such as scroll design, can be incorporated where the first security feature 16 incorporate parts of a phrase or pattern which interplay with other parts of a phrase or pattern forming the second security feature 17, which, when the substrate 12 is viewed as a whole in transmitted light combine to provide a full continuous design or a reporting phrase.

Where microlens arrays are used, this gives rise to a letter or other indicia that appears to float above the security element 10 as the visually verifiable first feature 16. The use of a microprism array, on the other hand, will give a metallic-to-clear switch when the substrate 12 is tilted.

It should also be noted that the first and second security feature(s) 16,17 may be similarly oriented, so that the substrate 12 does not need to be turned between reading/verifying both features. Alternatively, they may be oriented so that the first feature(s) 16 is at, say 90 degrees, to the second feature(s) 17.

The relative sizing of the first and second security features 16,17 can be varied. Thus, for example the first security features 16 are preferably large, to make them as visible as possible, whereas the second features 17 may be smaller. The nature of information displayed by the first and second features 16,17 can be such that when viewed in transmitted light they interplay or reference each other or carry through a theme, such as country or denomination of currency for a banknote.

In most of the embodiments described each set of security features 16,17 is registered exactly, so that the first set 16 only is exposed in the windows 11 and the second set 17 embedded. It is envisaged that there may be situations where it is desired to occasionally reveal one of the second features 17 in a window 11, say in every third window 11, whilst the other windows 11 only reveal the first features 16.

In another embodiment of the invention the whole of each first security feature 16 is exposed in each window 11 and the whole of each second security feature 17 is covered by the substrate 12.

The invention is particularly beneficial in that enables a set or series of documents to be produced which consistently include exactly the same combination of security features across the set or series. This would be particularly useful for banknotes and the features could be consistent within a particular domination or, alternatively, for all banknotes for a particular country. Thus in each element of a series or a sub-set of a series, the appearance and registration between the windows and the features on the security device will be same.

The invention claimed is:

1. A security substrate comprising at least one elongate security device, which security device has a series of first regions exposed at a series of windows formed in at least a first surface of the substrate and a series of second regions covered by the substrate at bridges formed between the windows in the first surface of the substrate, wherein each of the first regions comprises a first security feature which has substantially the same appearance in each region and is visible in each window when the first surface of the substrate is viewed in reflected light and the second regions comprise a second security feature which has substantially the same appearance in each second region but is different from the first security feature and is not visible when the first surface of the substrate is viewed in reflected light, but is visible when the first surface of the substrate is viewed in transmitted light, in which the security device is substantially wholly exposed at a second surface of the substrate.

2. A security substrate comprising at least one security device, which security device has a first region exposed at a window or aperture formed in at least a first surface of the substrate, and a second region covered by the substrate which is therefore not visible at the first surface of the substrate, wherein the first region comprises a first security feature which is visible when the first surface of the substrate is viewed in reflective light and the second region comprises a second security feature which is different from the first security feature and is not visible when the first surface of the substrate is viewed in reflective light, but is visible when the first surface of the substrate is viewed in transmitted light, in which the security device is substantially wholly exposed at a second surface of the substrate.

3. A security substrate as claimed in claim 2, in which the security device is a discrete patch.

4. A security substrate as claimed in claimed 2, in which the security device is an elongate element.

5. A security substrate as claimed in claim 1, in which the security device is partially embedded within the substrate.

6. A security substrate as claimed in claim 1, in which the security device is applied to the second surface of the substrate.

7. A security substrate as claimed in claim 1, in which only the first regions are in register with the windows.

8. A security substrate as claimed in claim 1, in which the first regions are in register with the windows, and further one or more of the second regions are also in register with the windows.

9. A security substrate as claimed in claim 1, in which the substrate is single ply.

10. A security substrate as claimed in claim 1, in which the substrate is multi-ply.

11. A security substrate as claimed in claim 1, in which the first and second security features interplay or reference each other when the substrate is viewed in transmitted light.

12. A security substrate as claimed in claim 1, in which the whole of each of the first security features is exposed in each window.

13. A security document made from the substrate of claim 1.

14. A security document as claimed in claim 13, in which the security document comprises a bank note, passport voucher, certificate, security bond, telephone card, smart card, bank card, or the like.

15. A set of identical security documents as claimed in claim 13, all having the same security features located in the same positions.

16. A security substrate as claimed in claim 2, in which the security device is partially embedded within the substrate.

17. A security substrate as claimed in claim 2, in which the security device is applied to the second surface of the substrate.

18. A security substrate as claimed in claim 2, in which the substrate is single ply.

19. A security substrate as claimed in claim 2, in which the substrate is multi-ply.

20. A security substrate as claimed in claim 2, in which the first and second security features interplay or reference each other when the substrate is viewed in transmitted light.

21. A security substrate as claimed in claim 2, in which the whole of each of the first security features is exposed in each window.

22. A security document made from the substrate of claim 2.

* * * * *